US007597594B2

(12) United States Patent
Stadler et al.

(10) Patent No.: US 7,597,594 B2
(45) Date of Patent: Oct. 6, 2009

(54) ELECTRICAL CONNECTING TERMINAL

(75) Inventors: Hermann Stadler, Donaueschingen (DE); Heike Anton, Blumberg (DE)

(73) Assignee: MC Technology GmbH, Blumberg (DE)

( * ) Notice: Subject to any disclaimer, the term of this patent is extended or adjusted under 35 U.S.C. 154(b) by 0 days.

(21) Appl. No.: 12/010,251

(22) Filed: Jan. 23, 2008

(65) Prior Publication Data

US 2008/0176457 A1 Jul. 24, 2008

(30) Foreign Application Priority Data

Jan. 24, 2007 (DE) ..... 10 2007 004 545

(51) Int. Cl.
*H01R 13/40* (2006.01)

(52) U.S. Cl. ..... 439/733.1

(58) Field of Classification Search ..... 439/733.1, 439/468, 717, 353, 681, 715, 716, 799, 801, 439/94, 713, 724, 810

See application file for complete search history.

(56) References Cited

U.S. PATENT DOCUMENTS 4,127,315 A * 11/1978 McKee ..... 439/468
4,415,214 A * 11/1983 Obst ..... 439/353
6,783,403 B2 * 8/2004 Lafragette et al. ..... 439/717

FOREIGN PATENT DOCUMENTS

| | | | |
|---|---|---|---|
| DE | 25 11 385 | A1 | 8/1976 |
| DE | 81 09 133 | U1 | 8/1981 |
| DE | 39 11 108 | A1 | 10/1990 |
| DE | 91 00 949 | U1 | 5/1991 |
| DE | 295 17 130 | U1 | 2/1996 |
| DE | 298 02 000 | U1 | 4/1998 |
| DE | 100 56 940 | A1 | 1/2002 |
| FR | 2 522 889 | A1 | 3/1982 |

* cited by examiner

*Primary Examiner*—Edwin A. Leon
(74) *Attorney, Agent, or Firm*—The Nath Law Group; Derek Richmond; Stanley N. Protigal

(57) ABSTRACT

This invention relates to an electrical connecting terminal (10) with an insulating housing (20), which contains a clamp body receptacle (22) with an insertion opening (21) for an electrical conductor, with a clamp body (30), which can be inserted into the clamp body receptacle (22) and has a connecting space (31) for the electrical conductor, said connecting space (31) being adjacent to the insertion opening (21), and within which a locking screw (40) is located in such a manner that the inserted electrical conductor is firmly clampable in the clamp body (30) by means of said locking screw (40), the clamp body (30) having at least one electrical contact, which is accessible from the base area (20*a*) of the housing (20), the housing (20) being of one-piece integral construction and having a plug-in opening (24) for the clamp body (30) on one side and being attachable to the clamp body (30) via a snap-in mechanism, the one-sided plug-in opening (24) being located in the base area (20*a*) of the housing (20).

21 Claims, 5 Drawing Sheets

ELECTRICAL CONNECTING TERMINAL

This disclosure relates to an electrical connecting terminal with an insulating housing, which contains a clamp body receptacle with an insertion opening for an electrical conductor, with a clamp body, which can be inserted into the clamp body receptacle and has a connecting space for the electrical conductor, said insertion space being adjacent to the insertion opening, and within which a locking screw is located in such a manner that the inserted electrical conductor is firmly clampable in the clamp body by means of said locking screw, the clamp body having at least one electrical contact, which is accessible from a base area of the housing.

Electrical connecting terminals having an insulting housing within which there is a clamp body receptacle with an insertion opening for an electrical conductor are known. A clamp body having a connecting space for the electrical conductor, said connecting space being adjacent to the insertion opening, can be inserted into the clamp body receptacle. A locking screw is located in the clamp body so that the electrical conductor inserted into the connecting space of the clamp body is firmly clampable within the clamp body by means of this locking screw. The clamp body has at least one electrical contact by means of which contact between the connecting terminal and, e.g., a printed circuit board can be established, said contact being accessible through a base area of the housing. Such a connecting terminal is, for example, disclosed by DE 39 01 307 A1.

The clamp body can be inserted into the insulating housing in different ways. According to DE 39 01 307 A1, the housing is open at the bottom, so that the clamp body can be pushed into the insulating housing from below, whereupon a base that can be snapped in is inserted into the housing so as to close the open bottom of the housing. This has the disadvantage that such housings having a base cannot be used for surface-mountable connecting terminals where the clamp body is to be soldered directly to the printed circuit board. In addition, because of the additional base, the cost for producing the housing is high.

A connecting terminal in which the clamp body is placed into the insulating housing from the front and is held in place by screwing in the locking screw is known from EP 0 584 481 B1. Such a housing is also not usable for surface mountable terminals.

DE 25 11 385 A1 discloses an electrical connecting terminal which dispenses with the base plate of the housing. The clamp body is built into the housing with the help of a retainer, with the retainer being held in the insulating housing so that it cannot be lost. This is in particular achieved in that the insulating housing has a snap-in recess and the retainer has a snap-in projection that engages the snap-in recess. However the retainer represents an additional component of the electrical connecting terminal whose production and installation are associated with additional costs.

It is the task of this invention to provide an electrical connecting terminal which can be produced economically. However, this connecting terminal is in particular also to be configurable as a surface mountable terminal.

This task is accomplished according to this invention by means of a connecting terminal characterized in that the housing is of one-piece integral construction, that it has a plug-in opening for the clamp body on one side and is attachable to the clamp body via a snap-in mechanism, the one-sided plug-in opening being located in the base area of the housing.

According to this invention, the housing is of one-piece integral construction, has a plug-in opening for the clamp body on one side, this plug-in opening being in the base area of the housing, and can be attached to the clamp body via a snap-in mechanism. The one-piece design of the housing firstly lowers production costs. The clamp body can be pushed into the insulating housing through the plug-in opening on one side. This plug-in opening is located in the base area of the housing so that the electrical contacts of the clamp body are directly accessible and can in particular, for example, be mounted directly onto the printed circuit board. It is in particular possible to also insert a clamp body into the housing, the electrical contact of which is configured as an SMD (Surface Mounted Device)-surface. According to this invention, the insulating housing is attached to the clamp body via a snap-in mechanism. The insulating housing is thus locked into place on the clamp body, thereby permitting a particularly simple and economical assembly. Neither a further assembly step to close the insulating housing by means of additional components nor some other fastening of the housing to the clamp body is thus needed. The connecting terminal can in particular be constructed in a simple manner and it needs only to contain a clamp body with the appropriate locking screw, without additional components for assembling the clamp body to the housing being necessary.

The snap-in mechanism preferably has at least one snap-in hook configured on the housing, so that, after being pushed onto the clamp body, the housing can engage a corresponding location on the clamp body, preferably a snap-in recess located on the clamp body, using the snap-in hook.

At least one slot, preferably two slots, are preferably located on at least one side of the housing bordering on the base area of the housing so that the housing can be pushed more simply onto the clamp body. The housing thus becomes more flexible because the housing can expand slightly along the slot, so that it becomes possible to insert the clamp body into the housing while for example also overcoming the snap-in mechanisms.

The clamp body receptacle preferably has a recess for the locking screw, this recess being equipped with ribs, which rest at least partially against the locking screw. These ribs prevent the screw from turning in the presence of vibrations, for example in case of transport of the connecting terminal or on installation of the connecting terminal in respectively vibrating devices.

The top side of the housing opposite the base area preferably has an opening through which the locking screw is accessible. This makes it possible to already push the insulating housing onto the clamp body when it is assembled and to possibly already mount the connecting terminal onto the printed circuit board, but to also to subsequently still connect the respective electrical conductor to the connecting terminal.

The opening in the top side of the housing can be configured so that the locking screw can also be subsequently inserted into the clamp body through this opening. The diameter of the opening is however preferably smaller than the diameter of the locking screw, thereby providing protection against the loss of the locking screw.

In a particularly preferred embodiment of this invention, the electrical contact of the clamp body is configured as contact pin, especially a soldering pin, or as an SMD surface. The SMD surface is, directly accessible through the housing of the connecting terminal, the housing being open on the bottom, and can readily be placed down directly onto the printed circuit board. When contact pins are used, the housing that is open on the bottom offers the benefit that no corresponding openings, through which the contact pins can be fed outwards through the housing from the clamp body receptacle, must be worked into the base area. In particular, such openings increase the cost of production and make it more difficult to assemble the connecting terminal.

The base area of the housing opposite the top side of the housing is preferably configured as a contact surface, which is preferably essentially planar, for an automatic placement machine, so that, for example, a suction gripper can act upon the surface in order make it possible to process the electrical connecting terminals automatically.

The invention will be described in detail on the basis of the following figures, which show

DETAILED DESCRIPTION

Figure 1:
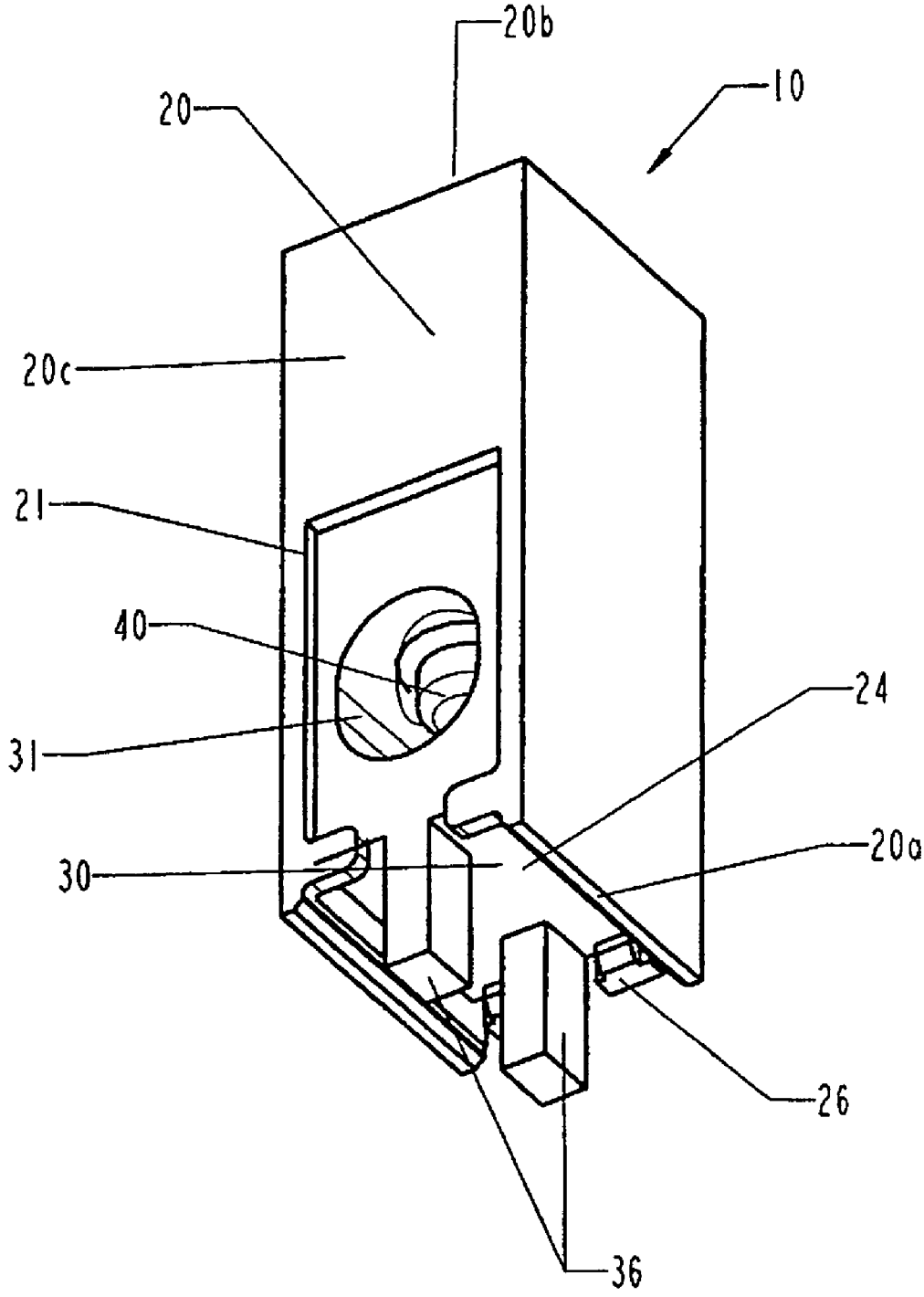
FIG. 1 a perspective view of a first example embodiment of the invention.
Figure 2:
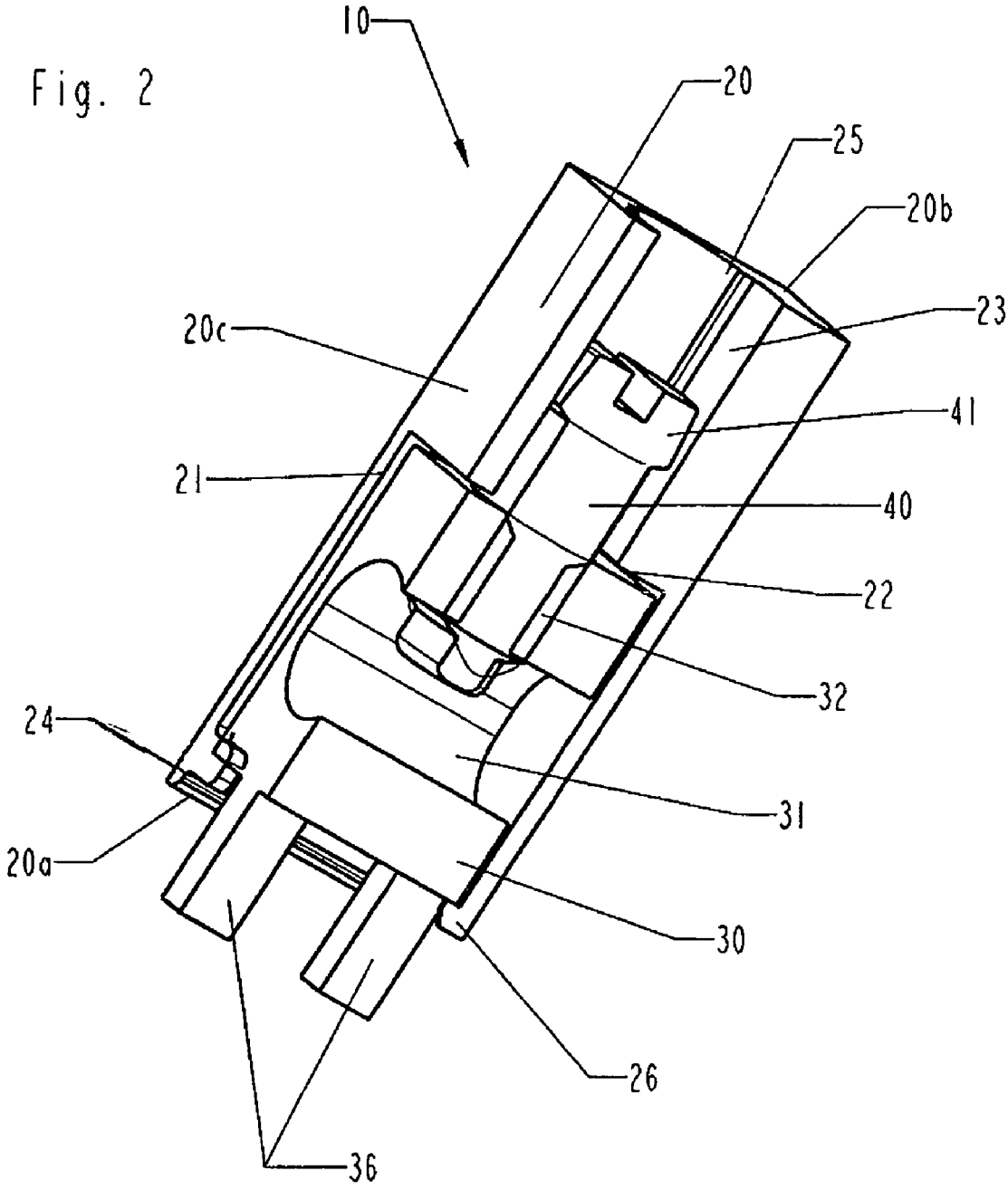
FIG. 2 a longitudinal section through the example embodiment in accordance with FIG. 1, FIG. 3 a perspective view of a second example embodiment of the invention, FIG. 4 a perspective view of a third example embodiment of the invention, FIG. 5 another perspective view of the example embodiment in accordance with FIG. 4 and FIG. 6 a longitudinal section through the example embodiment in accordance with FIG. 4.

FIG. 1 shows a perspective view, FIG. 2 a longitudinal section through a first example embodiment of a connecting terminal 10. The connecting terminal 10 has an essentially rectangular housing 20 with a base area 20*a*, a top side 20*b*, a front side 20*c* and a back side 20*d*. The housing 20 is essentially hollow and has a clamp body receptacle 22 for inserting a clamp body 30. The base area 20*a* is essentially designed open and thus forms a plug-in opening 24 for accommodating the clamp body 30. In the front side 20*c*, the housing 20 has an insertion opening 21 through which an electrical conductor can be inserted into the housing 20.

The clamp body 30 is made of an electrically conductive material and has a connecting space 31, which is adjacent to the insertion opening 21 when the clamp body 30 is assembled into the housing 20, so that an electrical conductor inserted through the insertion opening 21 comes to rest in the connecting space 31 of the clamp body 30. The clamp body 30 has a tapped hole 32, into which a locking screw 40 is inserted. By means of the locking screw 40, an electrical conductor introduced into the connecting space 31 of the clamp body 30 can be firmly clamped in the connecting space 31. The tapped hole 32 is arranged in the clamp body 30 so that the locking screw 40 points in the direction of the top side 20*b* of the housing 20 when the locking screw 40 has been screwed into the tapped hole 32 and when the clamp body 30 has been inserted into the clamp body receptacle 22 of the housing 20. The clamp body receptacle 22 has a recess 23, in which the locking screw 40, particularly its screw head 41, comes to rest. The recess 23 can be closed in the direction of the top side 20*b* of the housing 20. However it is preferably accessible through an opening 25, located in the top side 20*b* of the housing 20 so that the locking screw 40 can be actuated through the opening 25. The opening 25 can then be essentially as large as the largest diameter of the locking screw 40, i.e. essentially the diameter of the screw head 41 of the locking screw 40, so that the locking screw 40 can also be completely removed or replaced through the top side 20*b* of the housing 20. In an alternative embodiment, the diameter of the opening 25 is smaller than the largest diameter of the locking screw 40, thereby providing protection against the loss of the locking screw 40.

The recess 23 can have ribs, especially longitudinal ribs, which rest at least partly against the locking screw 40, in particular against the screw head 41 and which prevent the locking screw 40 from being inadvertently turned, for example due to vibrations.

The surface 20*b* is essentially configured flat so that in it contains at most the opening 25. Thus, the surface 20*b* is suitable as a contact surface for an automatic placement machine, which can for example act upon the surface 20*b* with a suction gripper.

As electrical contact, the clamp body 30 has two contact pins, in particular two soldering pins 36, which are located on the side of the clamp body 30 opposite the tapped hole 32 and which essentially come to rest in the base area 20*a* of the housing 20. But since the base area 20*a* is open in the downward direction through the plug-in opening 24, the soldering pins 36 protrude from the housing 20 through the base area 20*a* and can thus be attached directly to a printed circuit board. Since the soldering pin 36 is connected electrically with the clamp body 30, the electrical contact between an electrical conductor that has been pushed into the connector space 31 of the clamp body 30 and a conducting path of the printed circuit board can be established in this manner.

To ensure that the clamp body 30 cannot fall out of the housing 20, the housing 20 is snapped into the clamp body. For this purpose, snap-in hooks 26, which grab the underside of the clamp body 30 after the housing 20 has been pushed onto the clamp body 30, are located on the housing 20 in the region of the base area 20*a*. For example, the clamp body 30 can then also have recesses which the snap-in hooks 26 engage. The assembly of the connecting terminal 10 is clearly simplified in this way, since the insulating housing 20 needs only to be pushed over the clamp body 30 and thereafter becomes interlocked with it so that no further assembly steps are needed, in particular no assembly of an insulating base.

Figure 3:
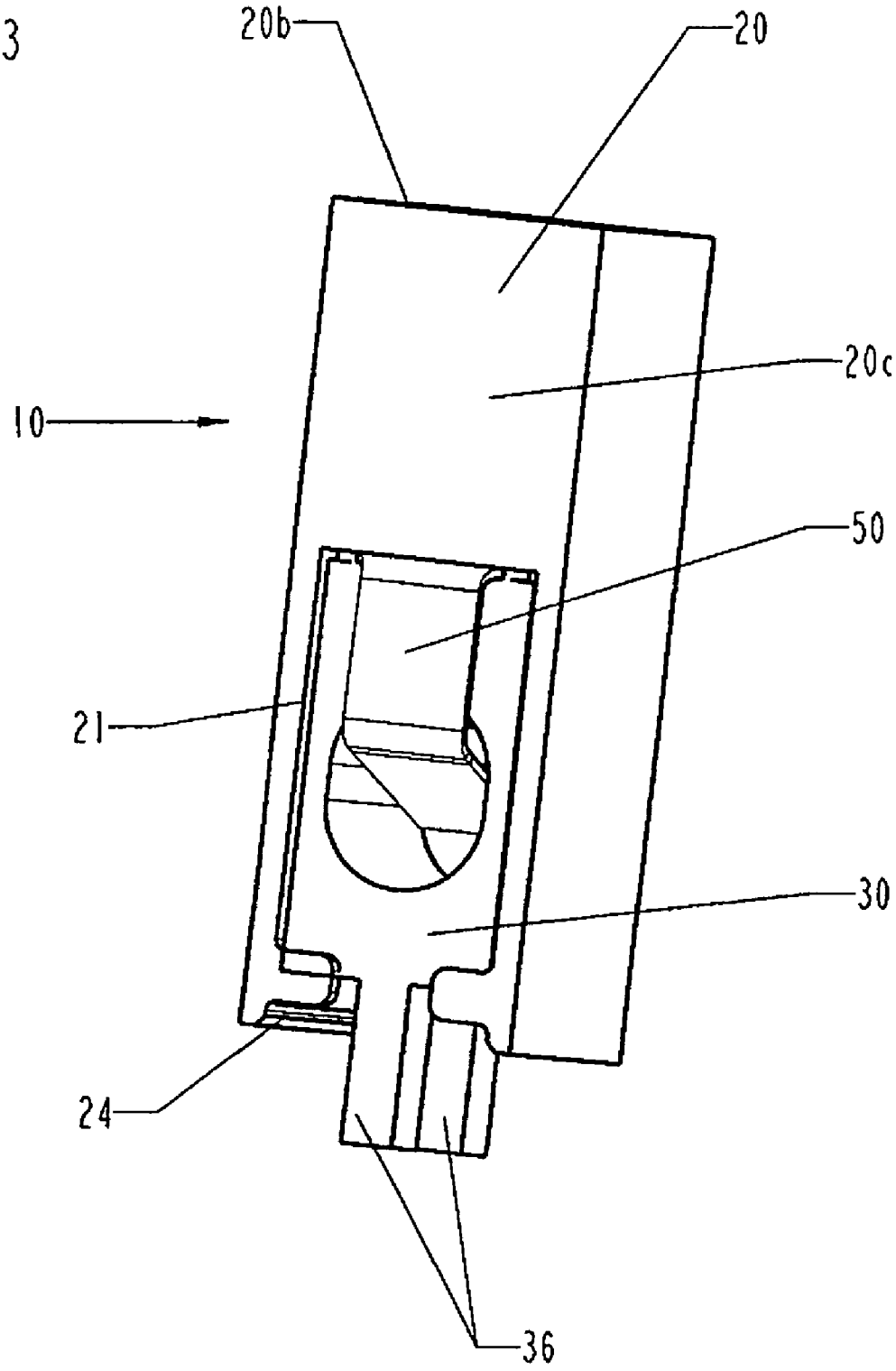

FIG. 3 shows a perspective view of a second example embodiment of the connecting terminal 10 with identical parts being labeled with the same reference numbers as those used for the example embodiment described by FIGS. 1 and 2.

The connecting terminal 10 shown in FIG. 3 differs from the example embodiment of the connecting terminal 10 shown in FIGS. 1 and 2 in that the present connecting terminal 10 has an additional wire protector 50, which is routed from the side of the clamp body 30 facing the top side 20*b* of the housing 20 over the front side of the clamp body 30 facing the front side 20*c* of the housing 20 into the connecting space 31 of the clamp body 30 and extends far enough into the connecting space 31 for the wire protector 50 to come to rest below the lower end of the locking screw 40. The wire protector 50 thus lies between an electrical conductor introduced into the connecting space 31 and the locking screw 40 so that it keeps the locking screw 40 from damaging the electrical conductor.

Figure 4:
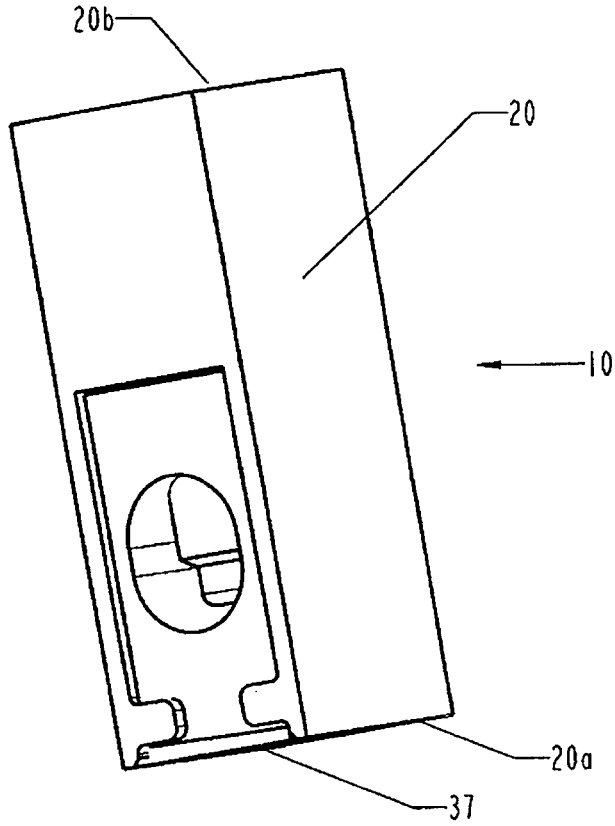
Figure 5:
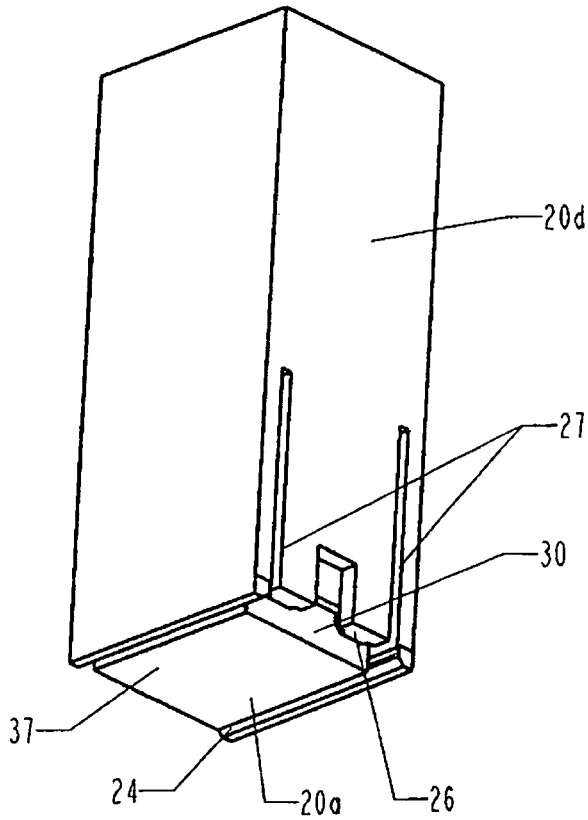
Figure 6:
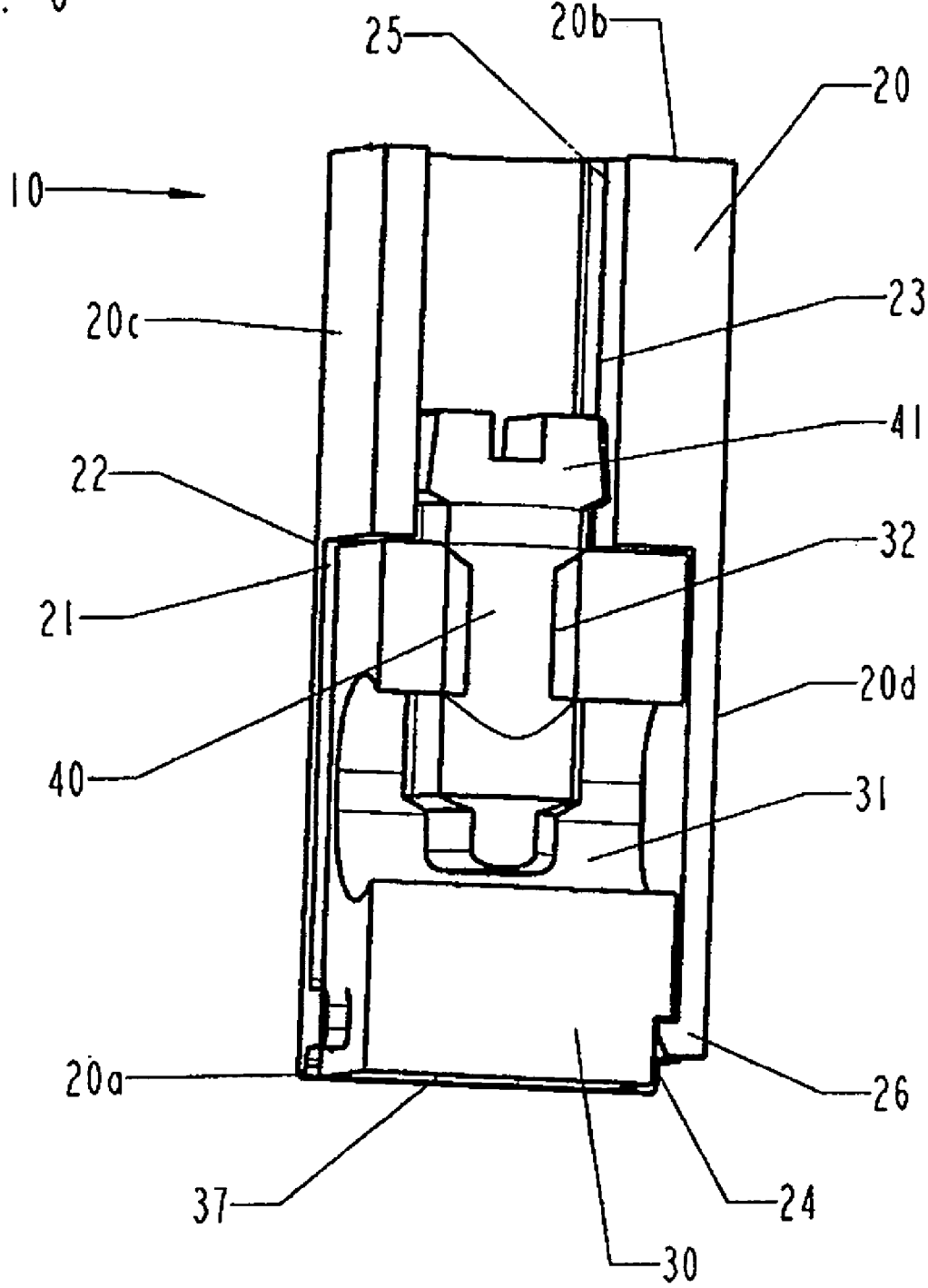

FIGS. 4 and 5 show two perspective views, FIG. 6 a longitudinal section through a third example embodiment of the connecting terminal 10. Identical parts are again labeled with the same reference numbers as in the first example embodiment according to FIGS. 1 and 2.

The present connecting terminal 10 differs from the first example embodiment of the connecting terminal 10 essentially in that the electrical contact of the clamp body 30 is not formed by the soldering pin 36, but rather by an SMD surface 37. The latter lies essentially in the base area 20*a* of the housing 20. The connecting terminal 10 can thus be mounted on an appropriate printed circuit board in a particularly simple way while providing reliable insulation of the connecting terminal 10.

As FIG. 5 shows, the back side 20*d* of housing 20 has two slots extending from the base area 20*a*. The slots 27 allow for simpler insertion of the clamp body 30 into the housing 20, since the housing 20 can deform, particularly expand, slightly along the slots 27 so that the clamp body 30 can be easily inserted into the housing 20, in particular to overcome the snap-in mechanism formed by the snap-in hooks 26.

Of course the wire protector 50 according to the second example embodiment shown in FIG. 3 can also be used in the third example embodiment. Similarly, the housing 20 according to the first example embodiment, which is shown in the FIGS. 1 and 2, can also have slots on the back side 20*d*. Furthermore, each housing 20 can also have additional ribs in the opening 23.

REFERENCE SYMBOL LIST

10 Connecting terminal
20 Housing
20*a* Base area
20*b* Top side
20*c* Front side
20*d* Back side
21 Insertion opening
22 Clamp body receptacle
23 Recess
24 Insertion opening
25 Opening
26 Snap-in hook
27 Slot
30 Clamp body
31 Connecting space
32 Tapped hole
36 Soldering pin
37 SMD surface
40 Locking screw
41 Screw head
50 Wire protector

The invention claimed is:

1. Electrical connecting terminal (10) comprising an insulating housing (20), which contains a clamp body receptacle (22) with an insertion opening (21) for an electrical conductor, with a clamp body (30), which can be inserted into the clamp body receptacle (22) and has a connecting space (31) for the electrical conductor, said connecting space (31) being adjacent to the insertion opening (21), and within which a locking screw (40) is located in such a manner that the inserted electrical conductor is firmly clampable in the clamp body (30) by means of said locking screw (40), the clamp body (30) having at least one electrical contact, which is accessible from a base area (20*a*) of the housing (20), characterized in that the housing (20) is of one-piece integral construction, that it has a plug-in opening (24) for the clamp body (30) on one side and is attachable to the clamp body (30) via a snap-in mechanism, the one-sided plug-in opening (24) being located in the base area (20*a*) of the housing (20).

2. Connecting terminal according to claim 1, characterized in that the snap-in mechanism has at least one snap-in hook (26) configured on the housing (20).

3. Connecting terminal according to claim 2, characterized in that the snap-in hook (26) engages a recess configured on the clamp body (30).

4. Connecting terminal according to claim 1, characterized in that at least one, preferably two slots (27) are located on the back side (20*d*) of the housing (20) adjacent to the base area (20*a*) of the housing (20) and extend from the base area (20*a*).

5. Connecting terminal according to claim 1, characterized in that the clamp body receptacle (22) has a recess (23) for the locking screw (40), said recess (23) having ribs that at least partially rest against the locking screw (40).

6. Connecting terminal according to claim 1, characterized in that an opening (25) through which the locking screw (40) is accessible is located in the base area (20*a*) of the housing (20) opposite the top side (20*b*).

7. Connecting terminal according to claim 6, characterized in that the diameter of the opening (25) is smaller than the diameter of the locking screw (40).

8. Connecting terminal according to claim 1, characterized in that the electrical contact of the clamping body (30) is a contact pin, in particular as soldering pin (36), or an SMD surface (37).

9. Connecting terminal according to claim 1, characterized in that the top side (20*b*) of the housing (20) opposite the base area (20*a*) of the housing (20) is usable as the contact surface for an automatic placement machine.

10. Connecting terminal according to claim 2, characterized in that at least one, preferably two slots (27) are located on the back side (20*d*) of the housing (20) adjacent to the base area (20*a*) of the housing (20) and extend from the base area (20*a*).

11. Connecting terminal according to claim 3, characterized in that at least one, preferably two slots (27) are located on the backs side (20*d*) of the housing (20) adjacent to the base area (20*a*) of the housing (20) and extend from the base area (20*a*).

12. Connecting terminal according to claim 2, characterized in that the clamp body receptacle (22) has a recess (23) for the locking screw (40), said recess (23) having ribs that at least partially rest against the locking screw (40).

13. Connecting terminal according to claim 3, characterized in that the clamp body receptacle (22) has a recess (23) for the locking screw (40), said recess (23) having ribs that at least partially rest against the locking screw (40).

14. Connecting terminal according to claim 4, characterized in that the clamp body receptacle (22) has a recess (23) for the locking screw (40), said recess (23) having ribs that at least partially rest against the locking screw (40).

15. Connecting terminal according to claim 2, characterized in that an opening (25) through which the locking screw (40) is accessible is located in the base area (20*a*) of the housing (20) opposite the top side (20*b*).

16. Connecting terminal according to claim 3, characterized in that an opening (25) through which the locking screw (40) is accessible is located in the base area (20*a*) of the housing (20) opposite the top side (20*b*).

17. Connecting terminal according to claim 4, characterized in that an opening (25) through which the locking screw (40) is accessible is located in the base area (20*a*) of the housing (20) opposite the top side (20*b*).

18. Connecting terminal according to claim 5, characterized in that an opening (25) through which the locking screw (40) is accessible is located in the base area (20*a*) of the housing (20) opposite the top side (20*b*).

19. Connecting terminal according to claim 5, characterized in that the electrical contact of the clamping body (30) is a contact pin, in particular as soldering pin (36), or an SMD surface (37).

20. Connecting terminal according to claim 6, characterized in that the electrical contact of the clamping body (30) is a contact pin, in particular as soldering pin (36), or an SMD surface (37).

21. Electrical connecting terminal (10) comprising an insulating housing made of one piece (20) and insertable into a clamp body (30), whereby the housing (20) comprises a floor area (20*a*), a top side (20*b*), a front side (20*c*) and a back side (20*d*) and a clamp body receptacle (22) whereby in the front side (20*c*) comprises an insertion opening (21) for an electrical conductor arranged with the back side (20*d*) as a single slot opening (24) constructed for the clamp body (30), whereby the clamp body is insertable in the clamp body receptacle (22) and exhibits a connecting piece (31) for the electrical conductor provided in the insulating housing (20), wherein the clamp body (30) connects to the insertion opening (21), whereby the clamp body (30) exhibits a threaded hole (32), in which a clamping screw (40) for clamping in a connection space (31) of the clamp body (30) in which the conductor may be inserted, whereby the clamp body receptacle (22) exhibits a recess (23), in which the clamping screw (40) with its screw head (41) comes to lie, whereby the clamp body (30) exhibits at least one electrical contact to produce an electrically conductive connection between the connection space (31) of the clamp body (30), receiving the inserted electrical conductor, and a circuit board, whereby the electrical contact is accessible through the base area (20*a*) of the housing (20) in the base area (20*a*), whereby at least one snap-in hook (26) is arranged, over which the insulating housing (20) after pushing onto the clamping body (30) is attachable to the clamp body (30).

* * * * *